United States Patent [19]

Walter et al.

[11] Patent Number: 4,521,180

[45] Date of Patent: Jun. 4, 1985

[54] LABORATORY BURNER APPARATUS

[75] Inventors: Carl W. Walter, Holliston; William J. Riordan, Shrewsbury, both of Mass.

[73] Assignee: Kidde, Inc., Saddle Brook, N.J.

[21] Appl. No.: 619,771

[22] Filed: Jun. 11, 1984

Related U.S. Application Data

[63] Continuation-in-part of Ser. No. 445,215, Nov. 29, 1982, abandoned.

[51] Int. Cl.[3] ..... F23N 5/24

[52] U.S. Cl. ..... 431/25; 431/24; 431/66; 431/88; 361/42

[58] Field of Search ..... 431/24, 25, 27, 88, 431/66; 361/254, 42, 47–50; 340/649

[56] References Cited

U.S. PATENT DOCUMENTS

| | | | |
|---|---|---|---|
| Re. 27,594 | 3/1973 | Power | 126/85 R |
| 2,431,158 | 11/1947 | Yates | 431/25 X |
| 3,270,799 | 9/1966 | Pinckaers | 431/25 |
| 3,426,342 | 2/1969 | De Langis | 340/649 |
| 3,714,517 | 1/1973 | Stracek | 361/42 |
| 3,847,533 | 11/1974 | Riordan | 431/78 |
| 4,380,428 | 4/1983 | Rozzi | 431/88 |

FOREIGN PATENT DOCUMENTS

| | | | |
|---|---|---|---|
| 2075218 | 11/1981 | United Kingdom | 431/24 |

OTHER PUBLICATIONS

"Electronics for the Power Engineer", by F. A. Annet, from Power vol. 94, Issue 9, Sep. 1950, p. 120.

*Primary Examiner*—Samuel Scott
*Assistant Examiner*—Allen J. Flanigan
*Attorney, Agent, or Firm*—John E. Toupal; Harold G. Jarcho

[57] ABSTRACT

A laboratory gas burner and control apparatus including a burner assembly made from electrically conductive material and adapted for positioning on a counter. Defined by the burner is an inlet for connection to a gas source and an outlet for feeding gas to a flame. An electrically operated valve controls the flow of gas to the burner outlet and an igniter is energizable by a power supply to ignite gas emanating from the burner outlet. Associated with the igniter is an activation circuit that produces either ignition periods during which the igniter is energized by the supply or non-ignition periods during which the igniter is deenergized. Initiation of each ignition period requires manipulation of a manual activation mechanism. Once ignited, the presence of flame at the burner outlet is detected by a flame sensing mechanism. A valve control circuit maintains the supply valve open only during either ignition periods or periods during which flame is detected by the sensing mechanism.

12 Claims, 4 Drawing Figures

LABORATORY BURNER APPARATUS

CROSS-REFERENCE TO RELATED APPLICATION

This application is a continuation in part of U.S. application Ser. No. 06/445,215, filed Nov. 29, 1982, entitled "Laboratory Burner Apparatus", now abandoned.

BACKGROUND OF THE INVENTION

This invention relates generally to laboratory burner apparatus and, more particularly, to a laboratory burner apparatus including an ignition and flame monitoring control system.

Gas burners commonly known as bunsen burners are employed in many industrial and academic laboratory facilities. Typically, such burners constitute a vertically supported tube connected to a source of gas by a manual gas cock and having variable air supply openings for adjusting the gas and air mixture so as to provide an intensity hot flame. Ignition of the bunsen burner's flame is usually accomplished with either a match, a cigarette lighter or a manually operated sparking device. Because of the inconvenience associated with such forms of ignition, bunsen burner flames are often allowed to burn during significant periods of unattached non-use. In addition to obviously wasting fuel, such unattended operation is inherently dangerous. In the event of a flame outage, the continued release of gas from an unsupervised burner can create an obviously hazardous environment.

The object of this invention, therefore, is to provide an improved laboratory gas burner that eliminates disadvantages inherently associated with conventional bunsen burners.

SUMMARY OF THE INVENTION

The invention is a laboratory gas burner and control apparatus including a burner assembly made from electrically conductive material and adapted for positioning on a counter. Defined by the burner is an inlet for connection to a gas source and an outlet for feeding gas to a flame. An electrically operated valve controls the flow of gas to the burner outlet and an igniter is energizable by a power supply to ignite gas emanating from the burner outlet. Associated with the igniter is an activation circuit that produces either ignition periods during which the igniter is energized by the supply or non-ignition periods during which the igniter is deenergized. Initiation of each ignition period requires manipulation of a manual activation mechanism. Once ignited, the presence of flame at the burner outlet is detected by a flame sensing mechanism. A valve control circuit maintains the supply valve open only during either ignition periods or periods during which flame is detected by the sensing mechanism. The provision of a manually operated automatic ignition system and an associated valve controlling flame detection circuit eliminates safety hazards existing with prior laboratory gas burners.

According to one feature of the invention, the igniter comprises a source of sparks for igniting gas emanating from the burner outlet and the flame sensing mechanism applies an AC potential across the region normally occupied by flame and detects the presence of current rectified by that flame. The use of a spark ignition system and a flame rectified current detection mechanism provides a laboratory burner that is both convenient and safe.

According to another feature of the invention, the igniter includes a single electrode for both generating ignition sparks and accommodating the flame rectified current for detection by the sensing mechanism. An isolation switch connected between the electrode and ground is open only during the the passage of sparks and thereafter isolates the burner to allow detection of flame rectified current. The use of a single electrode for both generating ignition sparks and providing flame rectified current reduces the cost of the overall system.

According to yet another feature of the invention, the power supply is an AC supply having hot, neutral and ground terminals and the system includes a ground proving circuit for automatically insuring the integrity of the ground terminal prior to each ignition period and for preventing an ignition period in the absence of a ground connection. This feature reduces the possibility of shocks that would accompany the passage of sparks from the energized electrode to a user's body in the absence of a good ground connection.

Another feature of the invention is an igniter activation mechanism that requires continuous manual contact to maintain energization of the igniter during the ignition periods. This feature prevents inadvertent sparking that could come without warning when an operator accidentally touches the spark electrode with a metal object.

According to still another feature of the invention, the control valve is connected for gas communication to the burner inlet by a tube formed of electrically nonconductive material and the system includes electrical conductor means connected between the burner and the power supply ground terminal. The nonconductive material tube facilitates a gas flow connection between the control system and the burner while the electrical conductor ensures grounding of the burner to permit the desired ignition sparking and flame detection functions.

Still another feature of the invention is a valve control circuit that includes an interrupter switch for both closing and maintaining closed the control valve in response to an abnormal orientation of the burner. This feature prevents dangerous continued flow of gas to the burner in the event of its inadvertent movement to a position tilted with respect to a normal vertical orientation.

According to another feature of the invention, the control system includes a manual deactivation switch for deenergizing the valve control circuit to close the control valve. The manual switch facilitates an assured interruption of gas flow when use in the burner is no longer required.

According to still other features of the invention, the system includes a housing retaining the power supply, the electrically operated valve, the flame sensing circuit and the valve control circuit and wherein the manual activation mechanism and the manual deactivation switch are disposed in a sidewall of the housing. The location of the control switches in a sidewall reduces the possibility of undesirable entry into the housing enclosed circuits of foreign material present in the laboratory environment.

DESCRIPTION OF THE DRAWINGS

These and other features and objects of the invention will become more apparent upon a perusal of the following description taken in conjunction with the accompanying drawings wherein.

DESCRIPTION OF THE PREFERRED EMBODIMENT

Figure 1:
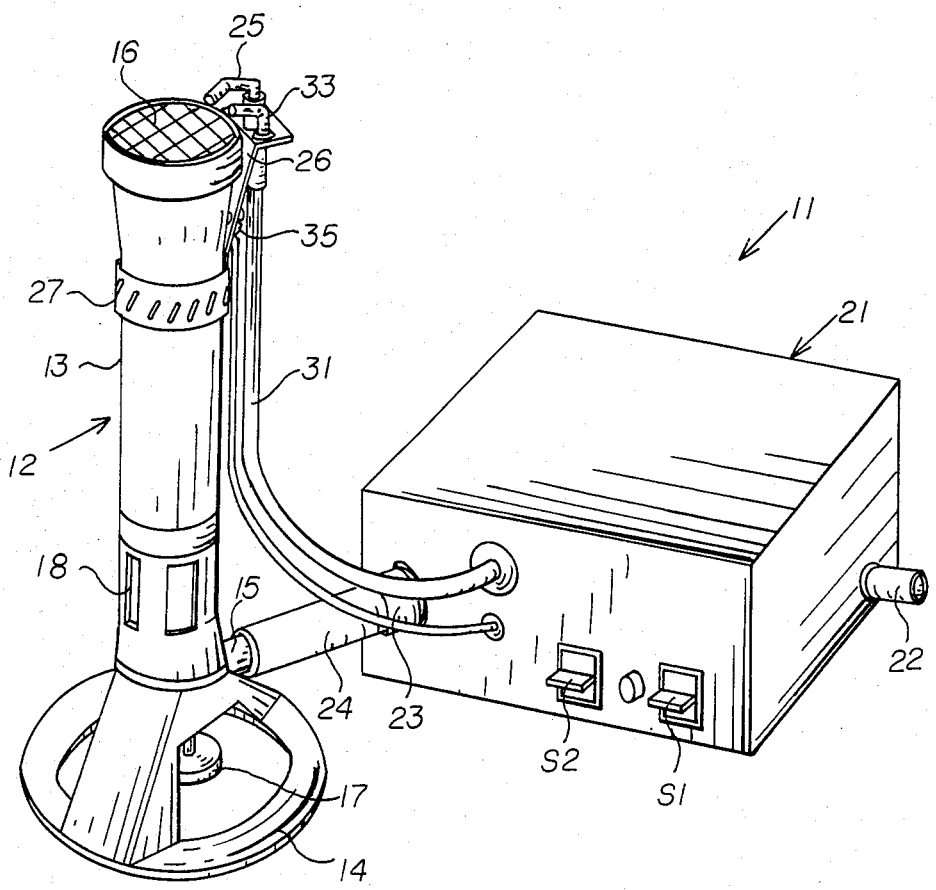
FIG. 1 is a schematic illustration of a laboratory gas burner according to the invention.

Schematically illustrated in FIG. 1 is a laboratory burner apparatus 11 constructed according to the invention. A gas burner 12 includes a vertically oriented, cylindrical body 13 supported by a base 14 adapted for use on a counter. Defined at the lower end of the body 13 is an inlet 15 for receiving a controlled flow of gas. An outlet 16 is defined by the upper end of the body 13 and discharges gas that is burned to provide a flame. Disposed between the inlet 15 and the outlet 18 is a manually operated gas cock 17 and a manually adjustable air inlet 18 for regulating the supply of air that mixes with the gas flowing out of the outlet 16.

Also included in the apparatus 11 is a housing 21 that retains an electrical burner control system that is described in greater detail hereinafter. Extending out of the housing 21 is an inlet pipe 22 for connection to a suitable source of gas and an outlet pipe 23 that is connected to the burner inlet 15 by a flexible, electrically non-conductive tube 24. A spark ignition electrode 25 is located in a flame zone directly adjacent to the burner outlet 16. Supporting and insulated from the spark electrode 25 is a bracket 26 that is secured to the body 12 by a clamp 27. Spark ignition voltage is transmitted by an electrical lead 31 that connects the electrode 25 to the control system within the housing 21. Supported by and electrically connected to the bracket 26 is a ground electrode 33 that is also located in the flame zone adjacent to the burner outlet 16. The ground electrode 33, the bucket 26 and the burner body 13 are grounded by a ground lead 34 that extends from the control system within the housing 21 and is terminated by a screw 35.

Figure 2:
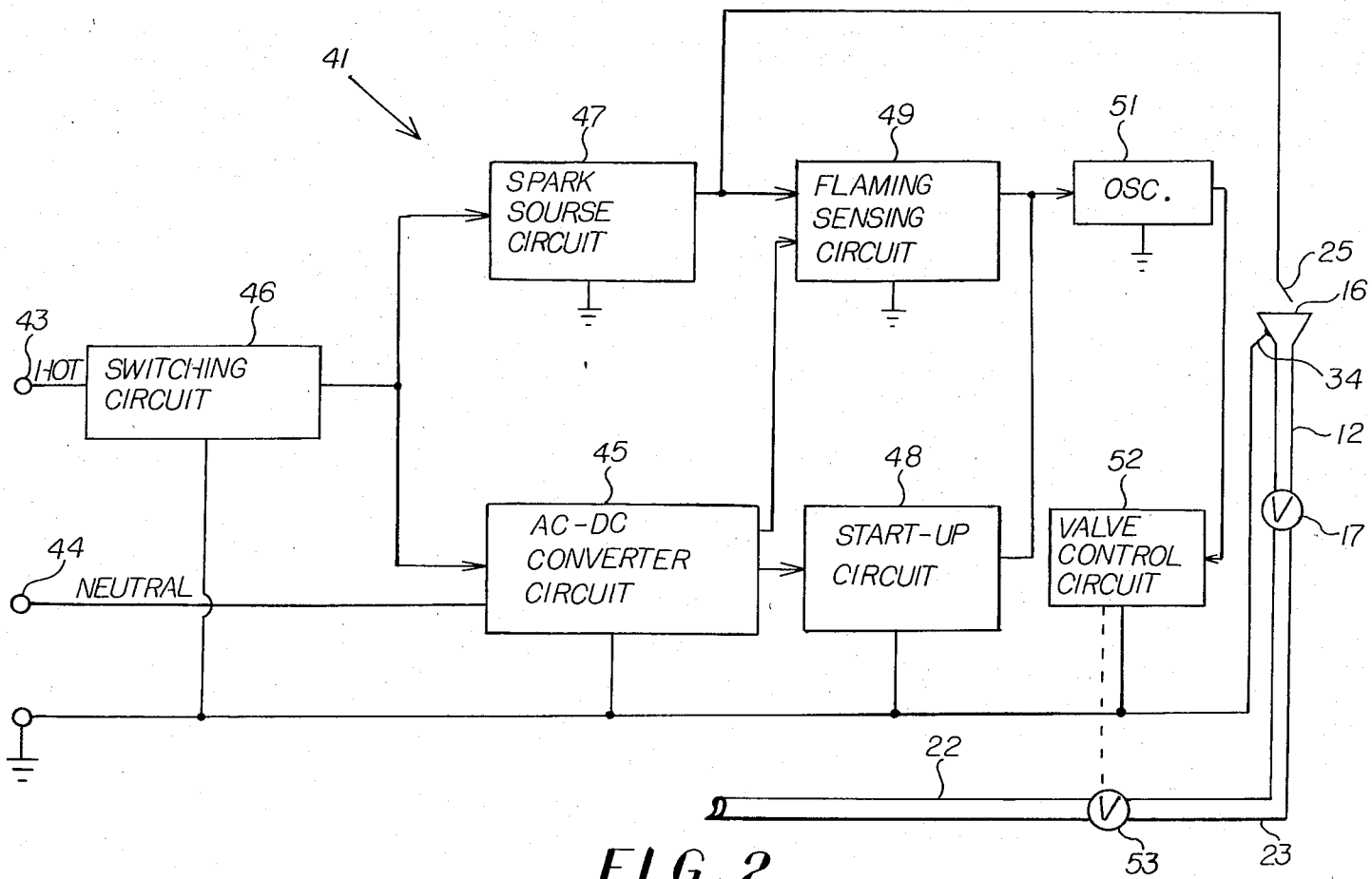
FIG. 2 is a schematic block diagram of an electrical control system for the burner shown in FIG. 1.

Schematically illustrated in FIG. 2 is a block diagram of the electrical control system 41 retained by the housing 21. A three wire AC supply includes a ground terminal 42, a hot terminal 43 connected to an activation switching circuit 46 and a neutral terminal 44 of which is connected to an AC-DC converter circuit 45. Power from the switching circuit 46 is transmitted to both the converter circuit 45 and a spark source circuit 47 that provides high voltage pulses to the spark electrode 25. Receiving power from the converter circuit 45 is a start-up circuit 48 and a flame sensing circuit 49 that also is connected to the spark electrode 25. Energy from either the start-up circuit 48 or the flame sensing circuit 49 powers an oscillator 51 that provides an output control signal to a valve control circuit 52. A valve 53 controls the flow of gas between the inlet 22 and the outlet 23 and is electrically controlled by the valve control circuit 52.

As described in greater detail below, the switching circuit 46 is manually activated to apply power to both the spark source 47 and the converter circuit 45 which in turn energizes the start-up circuit 48 and the flame sensing circuit 49. Energization of the start-up circuit 48 provides a temporary energy source for operating the oscillator 51, the resultant output of which causes the valve control circuit 52 to open the control valve 53. Simultaneously, the activated spark source 47 generates sparks that pass between the spark electrode 25 and the ground electrode 33 to ignite fuel emanating from the outlet 16. After the establishment of flame, the spark electrode 25 functions as a sensing electrode for transmitting flame rectified current to the flame sensing circuit 49. In response to the detection of flame, the flame sensing circuit 49 provides an output that powers the oscillator 51 which in turn causes the valve control circuit 52 to maintain the valve 53 in an open position. Either failure to establish flame or a subsequent loss thereof results in an absence of operating power for the oscillator 51 and causes lock out of the valve control circuit 52 to maintain the control valve 53 in a closed condition.

Figure 3:
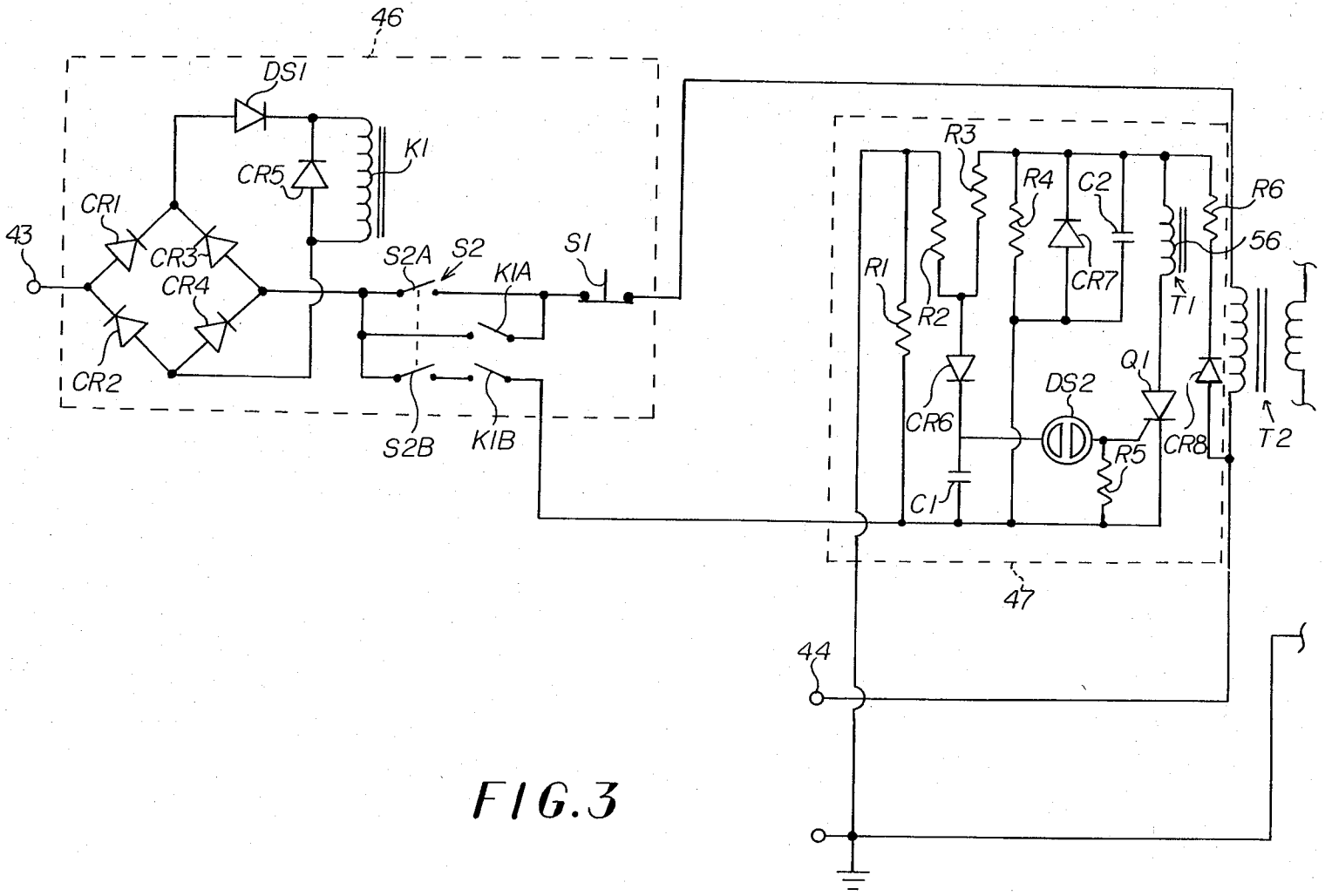
FIGS. 3 and 4 are a composite, schematic circuit diagram of the control system shown in FIG. 2.
Figure 4:
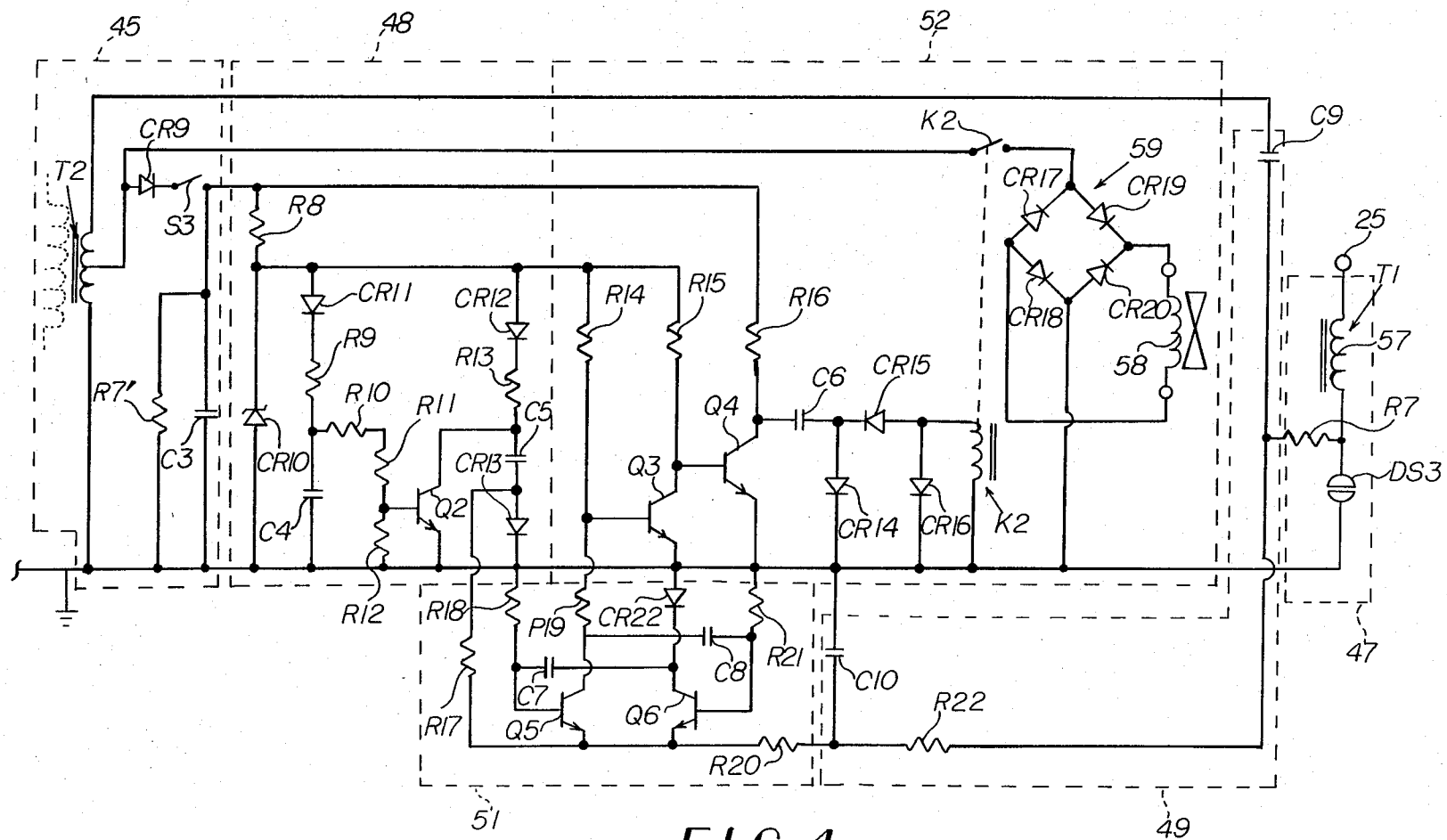

Referring now to FIGS. 3 and 4 there is shown in greater detail the circuits depicted by blocks in FIG. 2. As shown, the switching circuit 46 comprises a full wave bridge 54 including the diodes CR1–CR4, a normally closed momentary switch S1 and a momentary switch S2 with a pair of normally open contacts S2A and S2B. Also included in the switching circuit 46 are a light emitting diode DS1 and a relay winding K1 and associated relay contacts K1A and K1B.

The spark source 47 (FIG. 3) includes resistors R1–R6, capacitors C1 and C2, diodes CR6–CR8, a neon DS2, a transistor Q1 and a primary winding of a transformer T1. Also included in the spark source 47 and shown in FIG. 4 are the secondary winding of the transformer T1, a resistor R7 and a neon DS3. Receiving power from the supply 42 is the converter circuit 45 which includes a transformer T2, a diode CR9, a resistor R7 a capacitor C3 and a conventional tilt switch S3. The tilt switch S3 is closed when normally oriented and opens in response to a tilt therefrom of greater than 45°.

As shown in FIG. 4, the start up circuit 48 includes resistors R8–R13, capacitors C4 and C5, diodes CR10–CR13 and a transistor Q2. Also shown in FIG. 4 is the valve circuit 52 that includes resistors R14–R16, a capacitor C6, diodes CR14–CR16, transistors Q3 and Q4, a relay including a winding K2 and contacts K2A, a full bridge 55 including diodes CR17–CR21 and a solenoid winding 56 for controlling the valve 53.

The oscillator 51 which is actually an astable multivibrator includes resistors R17–R21, capacitors C7 and C8, a diode CR14 and transistors Q5 and Q6. Finally shown in FIG. 4 is the flame sensing circuit 49 which includes a pair of capacitors C9 and C10 and a resistor R22.

With terminals 43, 44 of the system 41 plugged into a 120 VAC line, no current initially flows as the switch S2 is spring loaded open. However, momentarily closing the switch S2 powers the transformer T2 through the bridge 54, the held closed contact S2A and the normally closed switch S1. The activity on the secondary of the transformer T2 causes primary current to increase pulling in the relay K1. While the switch S2 is depressed sparks are provided at the electrode 25 as described below. When a flame is established at the burner outlet 16, the switch S2 is released and the flame will continue without sparks as also described below. After release of switch S2, relay K1 is held in through its own closed contacts K1A to maintain current flow to the transformer T2.

With the switch S2 held closed, power is applied to the spark circuit 47 by the bridge 54, and the contacts S2B and K1B and sparks are generated at the electrode 25. The sparks are derived from the capacitor C2 which discharges into the primary of the step up transformer T1. The capacitor C2 is charged from the 120 VAC line through the diode CR8 and the resistor R6. At the same time the capacitor C1 is charged by current between the hot terminal 43 and the ground terminal 42 through the resistor R2 and the diode CR6. The time constant of the resistor R2 and the capacitor C1 is approximately 100 msec. When the capacitor C1 reaches approximatey 80 volts, the neon DS2 will break over and conduct a pulse of current to the gate of the SCR Q1 which will switch on dumping the capacitor C2 into the low voltage winding 56 of the transformer T1 and creating a spark between the electrode 25 and the grounded electrode 33. The components R2, C1, and DS2 make up a neon relaxation oscillator to provide a spark rate of approximately 10 per second. When a spark occurs, current flows from the electrode 25, jumps a spark gap to the ground electrode 33, through the lead 34 to chassis ground, up through the neon DS3 and back to the low side of the high voltage winding 57 of the transformer T1. The sparks ignite gas emanating from the burner outlet 16 as described below. Upon release of the momentary switch S2, the opened contacts S2B deenergize the spark circuit 47 to terminate sparking.

In the absence of a ground connection at the terminal 42, no current flow will occur through the resistor R2, the diode 6R6 and the capacitor C1. Accordingly, the capacitor will not become charged, the neon DS2 will not break over, and the SCR Q1 will not switch on to create sparks. The resistor R2, the diode CR6 and the capacitor C1, therefore, function as a ground proving circuit that automatically insures ground integrity and prevents an ignition period in the absence thereof. The risk of high voltage shocks to one handling the burner 12 is thereby greatly reduced.

Simultaneously with the production of sparks as described above, power is supplied to the transformer T2 through the bridge 54 and the closed contacts K1A and S1. Resultant secondary voltage energizes the start-up circuit 48 (FIG. 4) through the diode CR9 and the normally closed tilt switch S3. The diode CR9 and the capacitor C3 provide a DC power supply of approximately 12 volts and the resistor R7 is a bleeder. When power is first applied, the transistor Q2 will be off as the capacitor C4 will be at zero volts. With power applied the capacitor C5 will charge through the diode CR12, the resistor R13 and the diode CR13. After a short time, determined by time constant of the resistor R9 and the capacitor C4, the transistor Q2 will turn on. With the transistor Q2 on, the plus of the capacitor C5 will be tied to ground while the negative end is taken off ground by the diode CR13 which becomes back biased. Current can then flow from the plus of the capacitor C5 through the transistor Q2, to the collector and base components of the oscillator 51 out the emitters thereof and up through the resistor R17 to the return side of the capacitor C5. This is a limited energy source for the oscillator 51 and can provide starting current for only a finite time determined mainly by the size of the capacitor C5 and the resistor R17.

The transistor Q3 ordinarily has sufficient current from the resistor R14 to be fully saturated. However, with the oscillator transistor Q5 on, the current through the resistor R14 will be drained away causing the transistor Q3 to be cut off. As the transistor Q5 alternates at about 1500 Hz, transistor Q3 will switch on and off. When the transistor Q3 is off, its collector supply current from the resistor R15 will go to the base of the transistor Q4 which turns on. With the transistor Q4 off, the capacitor C6 will charge from the resistor R16, through the diode CR14. However, with the transistor Q4 on the capacitor C6 will discharge down through it and up through the coil of the relay K2 and the diode CR15. When the transistor Q4 again turns off, the relay coil supply will be interrupted but the diode CR16 will act as a free-wheeling diode to maintain some current and eliminate relay chatter. The closed contacts of the relay K2 energize the solenoid 58 through the bridge 59 which provides DC for efficiency and quiet operation. Energization of the solenoid 58 opens the valve 53 to initiate gas flow to the burner 12 for ignition by the sparks produced at the electrode 25.

Once flame is established at the burner 12 during the ignition period, the flame sensing circuit 49 detects that flame and provides power to the oscillator 51 that maintains a flow of fuel. As is well known, flame functions as a leaky diode which in this instance appears between the spark electrode 25 and the grounded electrode 33. Thus, the ac voltage of approximately 90 volts applied to the electrode 25 by the secondary of the transformer T2 produces a rectified current flow that charges the capacitor C9 through the resistor R7 and the secondary winding 57. The direction of that current flow is such that the side of the capacitor C9 connected to the resistor R22 is negative. The charge on the capacitor C9 is transferred through the resistor 22 to the capacitor C10 which acts to filter out any ac provided by the transformer T2. The capacitor C9 then supplies the oscillator 51 with power through the resistor R20. Once the oscillator is running as described above and flame continues, there exists a self-generating loop that insures a continued flow of gas.

It should be noted that the high voltage spark current and the flame rectification sensing current share the electrode 25. Ordinarily, the neon DS3 is off and appears open to allow the flame rectification operation. At the instant of spark, however, the diode DS3 turns on and conducts the spark current and then immediately shuts off. This sparking time is so short (several microseconds) that the influence is unnoticed. The resistor R7 provides circuit isolation and an additional function of limiting current to any person who may inadvertently touch the electrode 25.

It will be appreciated that after release of the switch S2, power to the oscillator 51 will be interrupted after the capacitor C5 discharges unless a flame is established to provide a flame rectified current as above described. Thus, if a flame is not established, the oscillator 51 will quit. Similarly, if flame is established and subsequently lost, the capacitor C10 will drain down in a second or two and again starve the oscillator 51. In either case, the transistor Q3 will be switched on to thereby switch off the transistor Q4 and terminate pulsing of the relay K2. Consequently, the relay contacts K2 will open to interrupt power to the valve solenoid 58 and thereby stop gas flow. When the relay K2 and the valve solenoid 58 are de-energized, the secondary current of the transformer T2 drops to an insignificant level and the reflected primary current correspondingly drops so low as to be unable to maintain K1 pulled in. When K1 drops out, all parts of the system 41 are depowered with no means of restarting on its own. The system 41 is then in lock-out.

When flame is no longer required, the system 41 can be forced into lock-out by momentarily depressing the normally closed switch S1. Similarly, the opening of the switch S3 resulting from an inadvertent tilting of the unit will result in lock-out.

What is claimed is:

1. Laboratory burner apparatus comprising:

a burner made from electrically conductive material and adapted for positioning on a counter, said burner comprising an inlet for connection to a gas source and an outlet for feeding gas to a flame;

an electrical power supply comprising an AC supply having hot, neutral, and ground terminals;

an electrically operated valve for controlling the flow of fuel to said burner;

an igniter means energizable by said supply to ignite fuel emanating from said outlet;

igniter activation means for producing either ignition periods during which said igniter means is energized by said supply or non-ignition periods during which said igniter is deenergized, said activation means comprising manual activation means for initiating each of said ignition periods;

said igniter activation means further comprising ground proving means for insuring the integrity of said ground terminal prior to each said ignition period, whereby said igniter means is not energized in the absence of a ground connection;

flame sensing means for detecting the presence of flame at said outlet; and valve control means for opening said valve only during said ignition periods and periods during which flame is detected by said sensing means.

2. Apparatus according to claim 1 wherein said igniter means comprises a source of sparks for igniting fuel emanating from said outlet.

3. Apparatus according to claim 2 wherein said flame sensing means comprises means for applying an AC potential across a region directly adjacent to said outlet, and detection means for detecting the presence of current rectified by flame at said outlet.

4. Apparatus according to claim 3 including means for grounding said burner and wherein said flame sensing means comprises an electrode for applying said AC potential, and said detection means detects flame rectified current passing between said electrode and said grounded burner.

5. Apparatus according to claim 4 wherein said sparks pass between said electrode and said burner during said ignition periods.

6. Apparatus according to claim 5 wherein said igniter means comprises an isolation switch means connected between said electrode and ground, said isolation switch being open only during the passage of sparks between said electrode and said burner.

7. Apparatus according to claim 1 wherein said igniter activation means requires continuous activation of said manual means to maintain energization of said igniter means during said ignition periods.

8. Apparatus according to claim 1 wherein said valve is connected for gas communication to said inlet by a tube formed of electrically non-conductive material, and including electrical conductor means connected between said burner and said ground terminal.

9. Apparatus according to claim 1 wherein said valve control means comprises interrupter switch means for closing and maintaining closed said valve in response to an abnormal orientation of said burner apparatus.

10. Apparatus according to claim 1 including housing means retaining said power supply, said electrically operated valve, said flame sensing means, and said valve control means; and wherein said manual activation means is disposed in a side wall of said housing.

11. Apparatus according to claim 10 including a manual deactivation switch for deenergizing said valve control means to close said valve, said deactivation switch being disposed in said side wall.

12. Apparatus according to claim 1 wherein said burner comprises manual valve means for regulating the flow of gas between said inlet and outlet, and manually adjustable air supply means for regulating the air flow to the flame region adjacent to said outlet.

* * * * *